United States Patent [19]

Toda

[11] Patent Number: 5,076,133

[45] Date of Patent: Dec. 31, 1991

[54] MUSICAL TONE SIGNAL GENERATING APPARATUS

[75] Inventor: Hiroyuki Toda, Hamamatsu, Japan

[73] Assignee: Yamaha Corporation, Hamamatsu, Japan

[21] Appl. No.: 595,042

[22] Filed: Oct. 10, 1990

[30] Foreign Application Priority Data

Oct. 11, 1989 [JP] Japan ..... 1-264332
Oct. 11, 1989 [JP] Japan ..... 1-264333

[51] Int. Cl.[5] ..... G10H 1/14; G10H 7/00
[52] U.S. Cl. ..... 84/624; 84/DIG. 10
[58] Field of Search ..... 84/607, 624, 659, 692–696, 84/DIG. 10

[56] References Cited

U.S. PATENT DOCUMENTS 4,297,933 11/1981 Nishimoto .
4,554,857 11/1985 Nishimoto .

FOREIGN PATENT DOCUMENTS 62-83795 4/1987 Japan .

*Primary Examiner*—Stanley J. Witkowski
*Attorney, Agent, or Firm*—Spensley Horn Jubas & Lubitz

[57] ABSTRACT

A musical tone signal generating apparatus provides at least plural modulation operation systems and plural memories, wherein each of the modulation operation systems carries out the predetermined modulation operation on each of plural pieces of input information applied thereto so that each of the memories stores the operation result thereof as the waveform information. These modulation operation systems are connected together such that plural pieces of waveform information stored in the memories are selectively supplied to each modulation operation system. By changing over the connections between the modulation operation systems and memories in the time-sharing system, the waveform operation is carried out based on the predetermined algorithms for forming the musical tone signal. Preferably, the predetermined modulation operation is the frequency-modulation operation.

8 Claims, 9 Drawing Sheets

MUSICAL TONE SIGNAL GENERATING APPARATUS

BACKGROUND OF THE INVENTION

1. Field of the Invention

The present invention relates to a musical tone signal generating apparatus which generates a musical tone signal by effecting a modulation operation on waveform information inputted thereto.

2. Prior Art

The conventional apparatus (as disclosed in Japanese Patent Laid-Open Publication No. 62-83795) provides plural input terminals to which input information is supplied, modulation operation units for carrying out a modulation operation based on the input information and plural memories. The memories memorizes the operation results (i.e., waveform information) of the modulation operation units. By changing over the connection between each modulation operation unit and each memory in time-sharing manner, this conventional apparatus carries out the waveform operation based on the predetermined algorithm.

In the above-mentioned conventional apparatus, by arbitrarily varying the output level of first-stage modulation operation unit, the input level of second-stage modulation operation unit is to be adjusted.

As the input information of each modulation operation unit, it is possible to use the waveform information which is operated by the former-stage modulation operation unit and then stored in the memories and other waveform information to be obtained from the feedback line to which the waveform information of the latter-stage modulation operation unit is applied. Then, each modulation operation unit carries out the modulation operation on the mixture or selected one of the above-mentioned waveform information and other input information.

As described above, in the conventional apparatus, the input level of the latter-stage modulation operation unit is adjusted by varying the output level of the former-stage modulation unit. This configuration is advantageous when the operation result of former-stage is used as the input of one latter-stage. However, it is disadvantageous when the operation result of former-stage is used as the inputs of plural latter-stages. In such case, the conventional apparatus cannot adjust the input level of each modulation operation unit independently.

Further, as the input information of each modulation operation unit, the conventional apparatus can use the mixture or selected one of the waveform information outputted from the former-stage modulation operation unit and other waveform information to be obtained from the feedback line to which the waveform information of the latter-stage modulation operation unit is applied. However, it is impossible to use the arbitrary combination of the above-mentioned waveform information as the input information of each modulation operation unit.

SUMMARY OF THE INVENTION

It is accordingly a primary object of the present invention to provide a musical tone signal generating apparatus which can generate the musical tone signal having high degree of freedom by flexibly connecting the modulation operation units.

In a first aspect of the present invention, there is provided a musical tone signal generating apparatus comprising:

a plurality of modulation operation systems each of which is applied with plural pieces of input information, each of the modulation operation systems carrying out a predetermined modulation operation on the input information applied thereto to thereby output waveform information as its operation result;

a plurality of memories each storing the operation result of each of the modulation operation systems; and a plurality of selecting unit each selecting one of plural pieces of the waveform information stored in the memories, so that plural pieces of selected information are supplied to each of the modulation operation systems as the plural pieces of input information, whereby a waveform operation is carried out so as to generate a musical tone signal based on a algorithm determined by a selection pattern of the selecting units.

In a second aspect of the present invention, there is provided a musical tone signal generating apparatus comprising:

a plurality of modulation operation systems each carrying out a predetermined modulation operation on each of plural pieces of input information applied thereto to thereby output waveform information as its operation result;

plural pairs of first registers to be coupled together in parallel for temporarily storing plural pieces of waveform information outputted from the modulation operation systems;

adding means for adding current waveform data outputted from each of the modulation operation systems to preceding waveform data stored in the first registers to thereby form new waveform data;

plural pairs of second registers to be coupled together in parallel for temporarily storing the new waveform data outputted from the adding means; and selecting means for selectively outputting the new waveform data stored in the second registers to the modulation operation systems.

In a third aspect of the present invention, there is provided a musical tone signal generating apparatus comprising:

a plurality of modulation operation systems each carrying out a predetermined modulation operation on each of plural pieces of input information applied thereto to thereby output waveform information as its operation result;

plural pairs of first registers to be coupled together in parallel for temporarily storing plural pieces of waveform information outputted from the modulation operation systems;

adding means for adding current waveform data outputted from each of the modulation operation systems to preceding waveform data stored in the first registers to thereby form new waveform data;

plural pairs of second registers to be coupled together in parallel for temporarily storing the new waveform data outputted from the adding means; and selecting means for selectively outputting the waveform data stored in the first and second registers to the modulation operation systems.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings.

DESCRIPTION OF A PREFERRED EMBODIMENT

[A] Configuration of Embodiment

Figure 1:
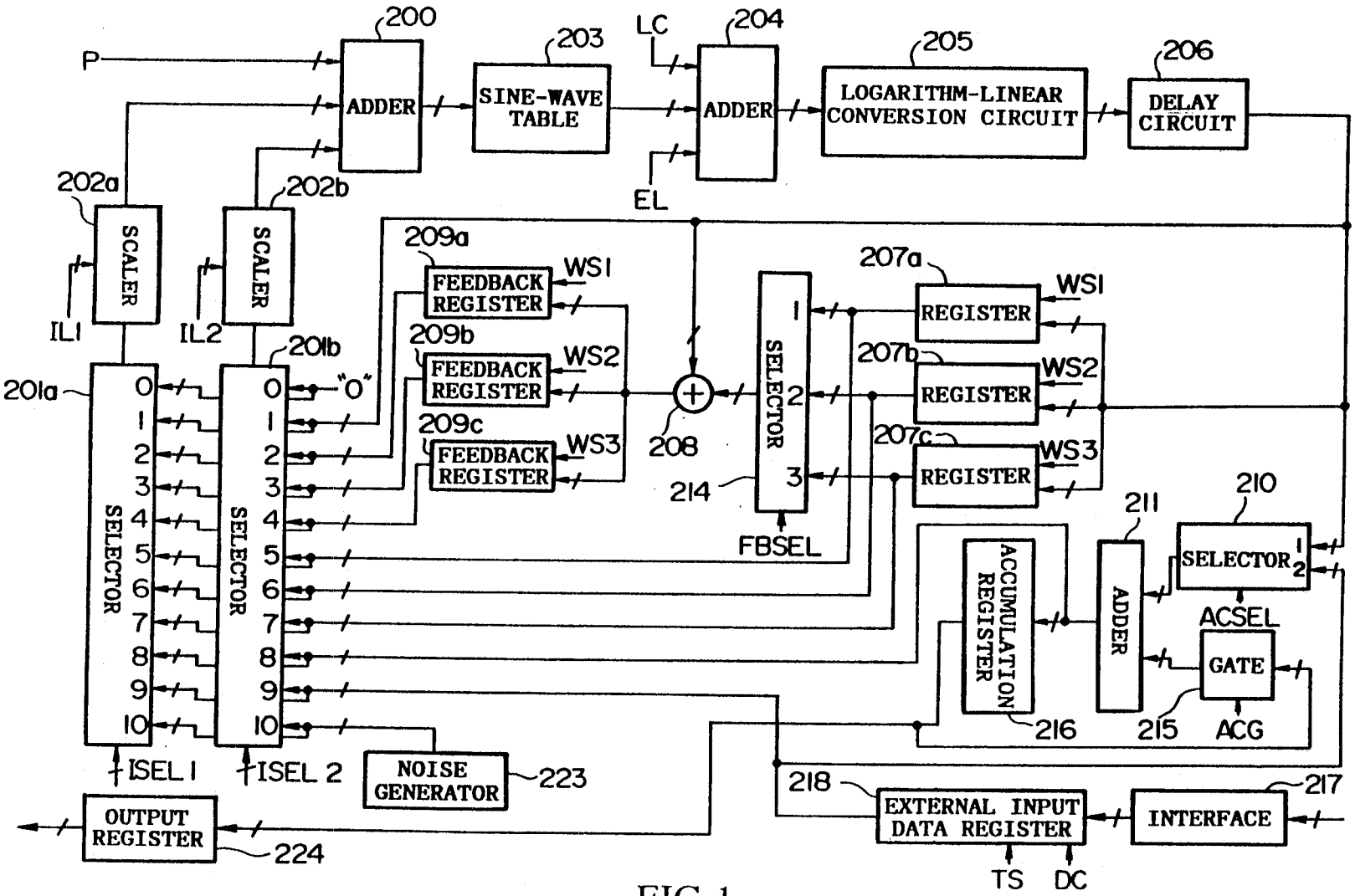
FIG. 1 is a block diagram showing an electric configuration of a musical tone signal generating apparatus according to an embodiment of the present invention.
Figure 2:
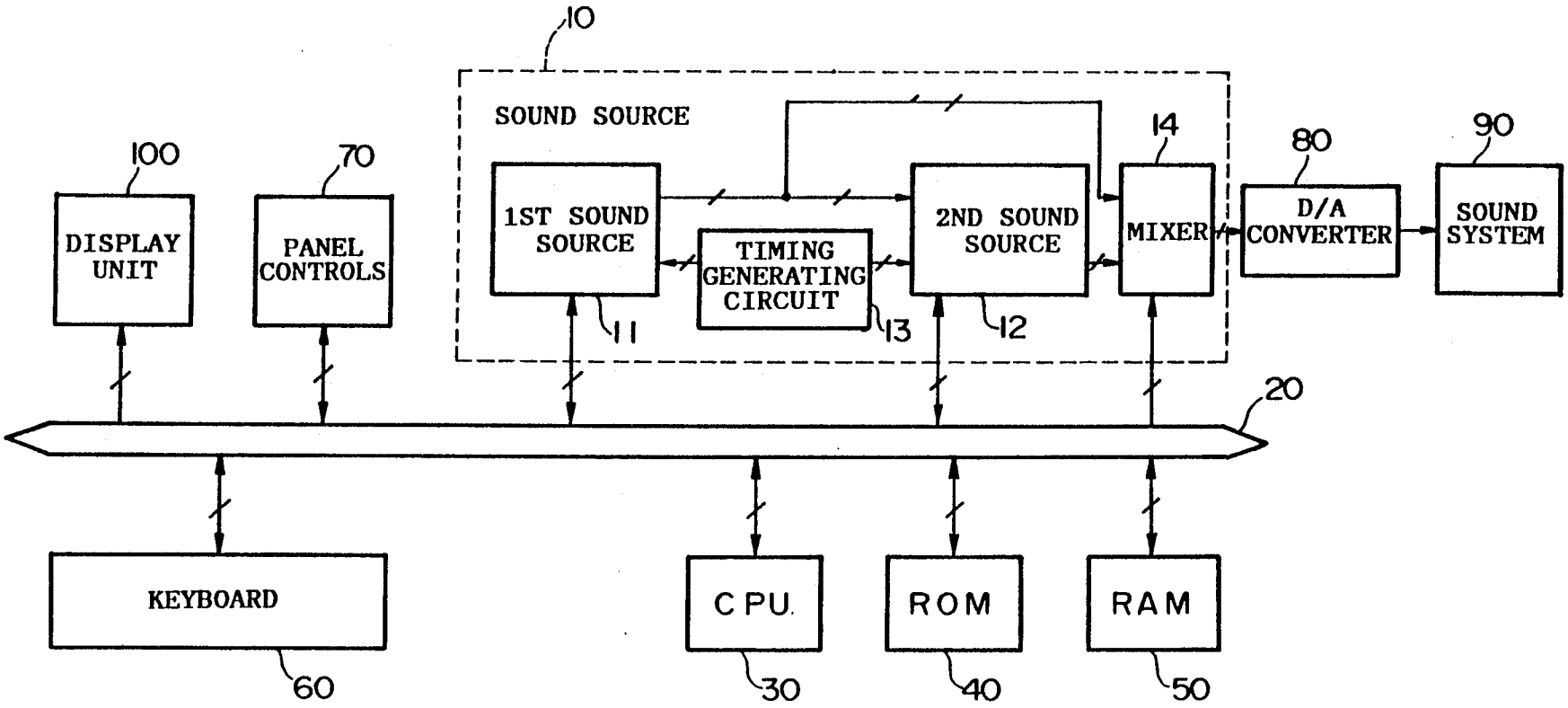
FIG. 2 is a block diagram showing an electronic musical instrument to which an embodiment of the present invention is applied.

Referring now to the drawings, wherein like reference characters designate like or corresponding parts throughout the several views, FIG. 2 is a block diagram diagrammatically showing the whole configuration of the electronic musical instrument to which the musical tone signal generating apparatus according to an embodiment of the present invention as shown in FIG. 1 is applied.

The electronic musical instrument as shown in FIG. 2 provides a frequency-modulation-type sound source 10. Herein, a central processing unit (CPU) 30 coupled to a bus 20 executes the predetermined processings based on the prestored programs of a read-only memory (ROM) 40 by using a work area provided in a random-access memory (RAM) 50, by which generation of the musical tone is controlled in response to the operations of a keyboard 60 and panel controls 70. The output terminal of the sound source 10 is connected to a sound system 90 via a digital-to-analog (D/A) converter 80. The sound system 90 is constructed by the amplifier, speaker and the like. The D/A converter 80 converts the digital output of the sound source 10 into the analog musical tone signal, hence, the sound system 90 generates the musical tone corresponding to the analog musical tone signal supplied thereto. This electronic musical instrument further provides a display unit 100 which visually displays the tone color setting state which is controlled by the panel controls 70. Incidentally, in several drawings, the arrow line accompanied with "/" indicates a signal line through which the signal of plural bits is transmitted, while another arrow line indicates a signal line through which the signal of single bit is transmitted.

Further, the sound source 10 includes a first sound source 11 and a second sound source 12, in which the system clock timing is synchronized with the channel clock timing by a synchronization signal outputted from a timing generating circuit 13. The control signals outputted from the CPU 30 are supplied to the first and second sound sources 11, 12 via the bus 20, so that the first and second sound sources 11, 12 generate the musical tone signals based on the control signals supplied thereto. These musical tone signals outputted from the first and second sound sources 11, 12 are mixed together in a mixer 14. In addition, the musical tone signal outputted from the first sound source 11 is also supplied to the second sound source 12.

Figure 3:
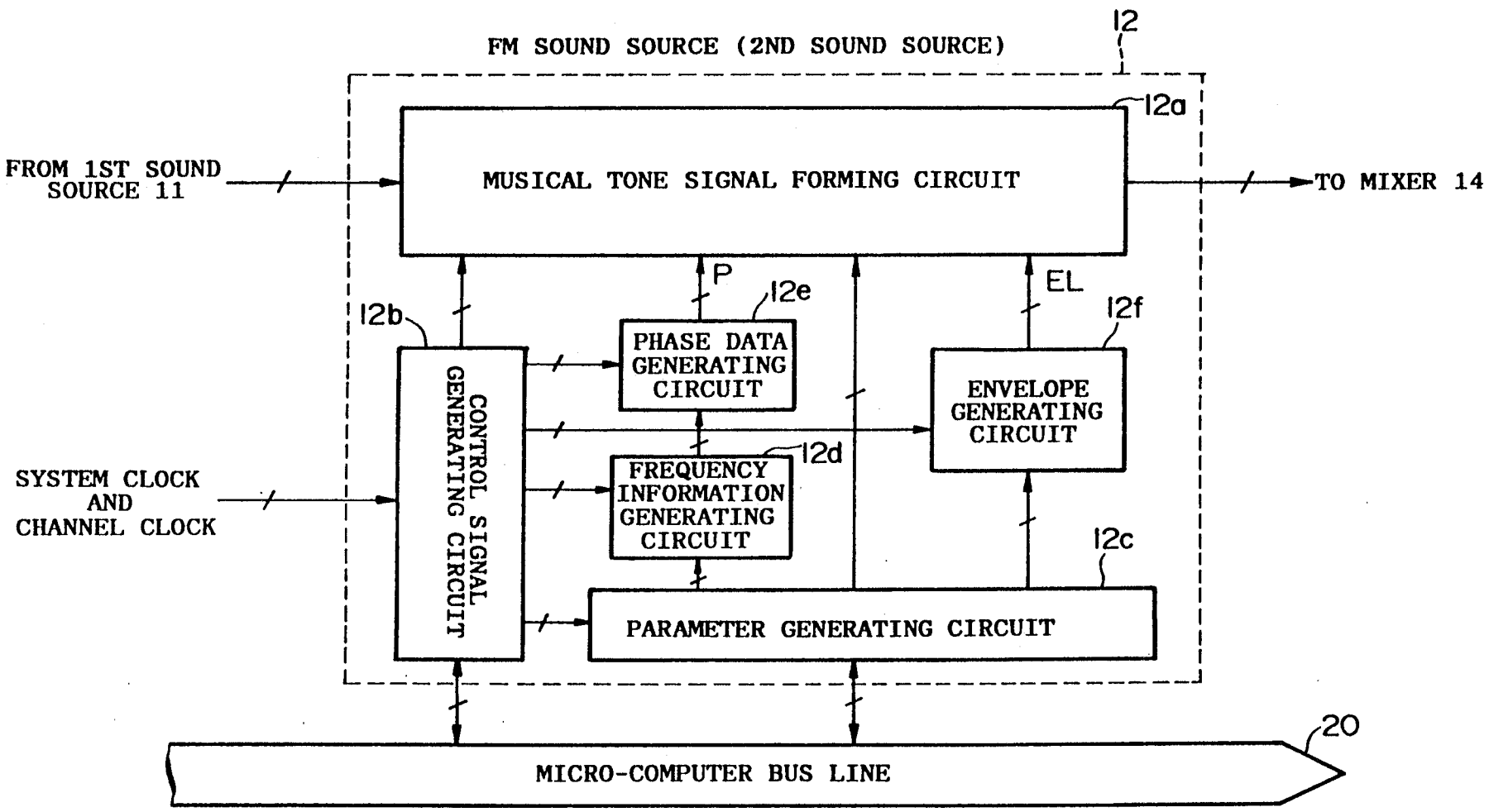
FIG. 3 is a block diagram showing a detailed configuration of a second sound source shown in FIG. 2.

As shown in FIG. 3, the second sound source 12 provides a musical tone signal forming circuit 12*a* which carries out the waveform operation.

This musical tone signal forming circuit 12*a* is designed to form a musical tone signal in response to the external waveform signal, several kinds of control signals for setting the tone color and the like, phase data signal representative of frequency information and envelope signal. The above-mentioned external waveform signal is supplied from the first sound source 11, while the other signals are supplied from a control signal generating circuit 12*b*, a parameter generating circuit 12*c*, a frequency information generating circuit 12*d* (hereinafter, frequency information will be referred to as "F-number), a phase data generating circuit 12*e* and an envelope generating circuit 12*f*. Herein, the circuits 12*c*, 12*d*, 12*e* and 12*f* are activated by the control signals outputted from the control signal generating circuit 12*b*.

Incidentally, detailed description will be given with respect to the above-mentioned signals by referring to FIG. 1 to be accompanied with the detailed description of the circuit configuration of the musical tone signal forming circuit 12*a*.

The musical tone signal forming circuit 12*a* contains modulation operation units (hereinafter, simply referred to as operation units) which carries out the sine-wave function operation on data representative of the phase angle. Herein, the waveform operation is repeatedly performed on the combination of the inputs and outputs of the operation units. In other words, the operation system is constructed by mutually connecting the operation units in the predetermined connection manner. In this circuit 12*a*, one operation cycle is divided into plural time slots, on each of which the waveform operation is carried out. In addition, each waveform operation to be carried out with respect to each time slot provides plural channels in order to generate the polyphonic output.

The input phase angle of the sine-wave function is obtained from an adder 200 (see FIG. 1) which adds three pieces of input information together. Herein, first input information represents phase information which is obtained by adding the phase angle from the F-number generating circuit 12*d* by every clock timing in the phase data generating circuit 12*e*. In addition, each of selectors 201*a*, 201*b* selects one of plural pieces of input information applied thereto, and then the selected input information is subject to the level correction in each of scalers 202*a*, 202*b*, which outputs are supplied to the adder 200 as second and third input information respectively. Each of the selectors 201*a*, 201*b* receives eleven pieces of input information, one of which is selected in response to each of control signals ISEL1, ISEL2 outputted from the control signal generating circuit 12*b*. Further, the level corrections made by the scalers 202*a*, 202*b* are controlled by control signals IL1, IL2 respectively outputted from the parameter generating circuit 12*c*.

The phase information (i.e., addition result of the adder 200) is supplied to a sine-wave table 203 as address data. In response to each address, the corresponding sine-wave function value is read from the sine-wave table 203. In order to simplify the envelope applying operation and change of the modulation index, the sine-wave table 203 stores the sine-wave function value as the logarithmic value. Next, an adder 204 adds the read sine-wave function value to an envelope index EL and a modulation index LC. Then, the addition result of adder 204 is supplied to a logarithm-linear conversion circuit 205. In this case, the envelope index EL is outputted from the envelope generating circuit 12*f*, while the modulation index LC is outputted from the parameter generating circuit 12*c*.

The output of logarithm-linear conversion circuit 205 is supplied to a delay circuit 206 containing shift registers, which number corresponds to the number of channels. This output is delayed by one time slot period, and then supplied to the selectors 201*a*, 201*b*, registers 207*a* to 207*c*, feedback registers 209*a* to 209*c* via an adder 208 and also supplied to an adder 211 via a selector 210.

Figure 4:
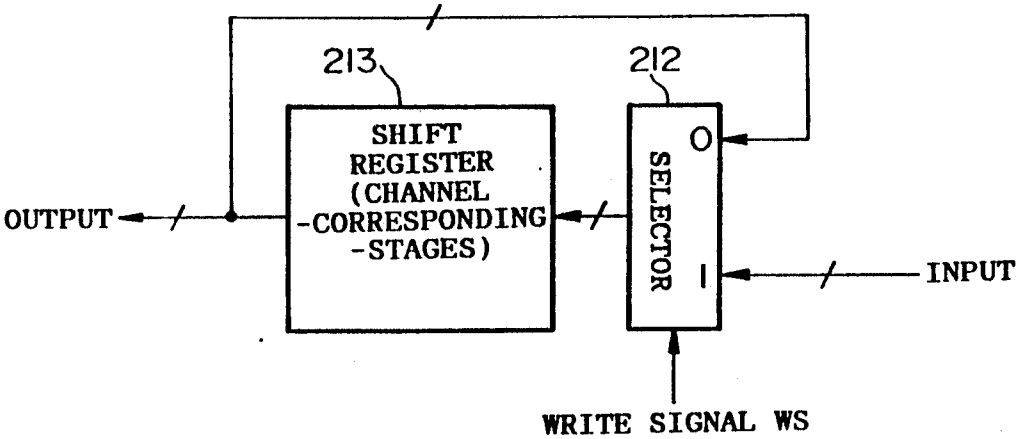
FIG. 4 is a block diagram showing a register shown in FIG. 1.

In the present embodiment, each of the registers 207*a* to 207*c* and feedback registers 209*a* to 209*c* is configured by a selector 212 having two inputs and a shift register 213 of which number of stages corresponds to the number of channels as shown in FIG. 4. When the level of a write signal WS (i.e., WS1 to WS3) is turned from "0" to "1", each register holds the data at that timing. For example, when the write signal WS is at "0", the selector 212 selects the output of the shift register 213 so that the output of the shift register 213 is directly fed back to the shift register 213 via the selector 212. Due to such feedback loop, the data at the timing when WS is at "0" is maintained as it is. On the other hand, when the write signal WS is turned to "1" level, the selector 212 selects the input data from the external portion, so that such input data is written in the shift register 213.

In addition to a selection control signal FBSEL to be supplied to a selector 214, the control signal generating circuit 12*b* outputs the write signals WS1 to WS3. Therefore, the data writing timings of the registers 207*a* to 207*c* are synchronized with those of the feedback registers 209*a* to 209*c*. In addition, these signals FBSEL, WS1 to WS3 are controlled such that same data is designated by these signals. For example, when the write signal WS is set at "1", the selection control signal FBSEL is also set at "1" so that the selector 214 selects the input terminal "1". At this time, the adder 208 adds the output of delay circuit 206 to the data stored in the register 207*a*, and then the addition result thereof is stored in the feedback register 209*a*. The above-mentioned operation control is provided in order to average the data and thereby prevent the hunting phenomenon from being occurred due to the feedback operation performed by the operation units. Incidentally, the registers 207*a* to 207*c* are paired with the feedback registers 209*a* to 209*c* respectively, so that there are provided three register pairs in FIG. 1.

The output terminal of the delay circuit 206 is connected to the first input terminal "1" of the selector 210, which output terminal is connected to the first input terminal of the adder 211. On the other hand, the second input terminal of the adder 211 is connected with an output terminal of gate 215. In addition, the output terminal of the adder 211 is connected to an input terminal of accumulation register 216, which output terminal is connected to an input terminal of the gate 215. In short, an accumulator is configured by the adder 211, accumulation register 216 and gate 215. Further, the second input terminal of the selector 210 is connected to an external input data register 218 which receives the external input data from the external portion (not shown in FIG. 1) via an interface 217.

The selecting operation of the selector 210 and the on/off state of the gate 215 are respectively controlled by control signals ACSEL, ACG outputted from the control signal generating circuit 12*b*. When the control signal ACSEL is at "1", the selector 210 selects the first input terminal "1" thereof (i.e., the output of delay circuit 206). In this state, when the control signal ACG is at "1" so that the gate 215 is in the on-state, the outputs of the delay circuit 206 are sequentially accumulated in the accumulation register 216. In contrast, when the control signal ACG is at "0" so that the gate 215 is in the off-state, the output of delay circuit 206 is newly inputted into the accumulation register 216. On the other hand, when the control signal ACSEL is at "2" so that the selector 210 selects the output of external input data register 218, the external input data is accumulated in the accumulation register 216.

Further, when the control signal ACSEL is at "0", the selector 210 terminates its selecting operation and thereby outputs "0" data. In this case, when the control signal ACG is at "1" so that the gate is in the on-state, the data of the accumulation register 216 is circulated in the loop consisting of the gate 215, adder 211 and accumulation register 216 so that such data is maintained as it is.

Figure 5:
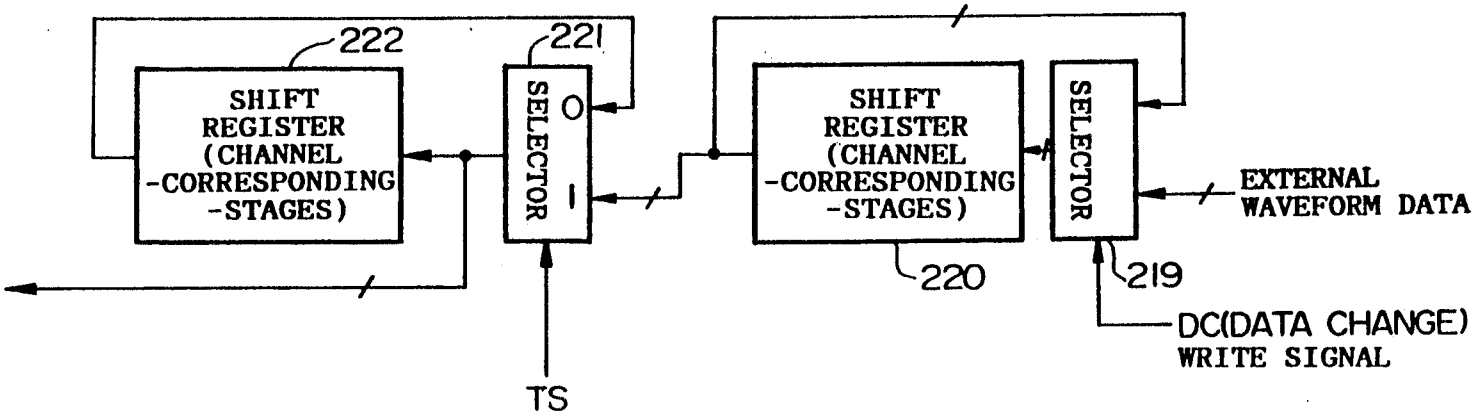
FIG. 5 is a block diagram showing an external input data register shown in FIG. 1.

The external input data register 218 contains two sets of registers to be connected in serial, each consisting of the selector and shift register of which number of stages corresponds to the number of channels as shown in FIG. 5. Herein, a selector 219 performs the selecting operation thereof in response to a data change write signal DC. When the data change write signal DC is changed from "0" to "1", the shift register 220 inputs the external waveform data. At a timing when a control signal TS supplied to a selector 221 is changed from "0" to "1", contents of data stored in a shift register 222 is renewed by new external waveform data.

The selectors 201*a*, 201*b* input the "0" data, the outputs of the delay circuit 206, feedback registers 209*a* to 209*c*, registers 207*a* to 207*c*, adder 211, external input data register 218 and further input noise data from a noise generator 223. Each of these selectors selects one of the above-mentioned eleven input data thereof in response to each of the control signals ISEL1, ISEL2, which value ranges from "0" to "10".

The output of the accumulation register 216 is outputted via an output register 224 as the output of musical tone signal forming circuit 12*a*, which is further outputted to the mixer 14 (see FIGS. 2, 3).

[B] Operation of Embodiment

Next, description will be given with respect to the operation of the electronic musical instrument which configuration is described above.

After turning on the power switch (not shown), the performer carries out the sound-making-operation before performing the music.

Such sound-making-operation is carried out by operating the panel controls 70, which operation contents is displayed in the display unit 100. When making the sounds, one of the preset tone colors can be selected by operating the button switches, and the panel controls 70 can be operated such that detailed information indicative of the contents of making the sounds in the sound source 10 is transferred to the desirable portion. As the detailed operation for making the sounds, the tone colors are respectively set in the first and second sound sources 11, 12 and then the mixing rate of two tone colors to be used in the mixer 14 is determined; the algorithm is set for the musical tone signal forming circuit 12*a* within the second sound source 12.

After completing the operations for making the sounds, the performance can be started. When the performer depresses the key in the keyboard 60, the CPU 30 detects the depressed key and the key-depression state in accordance with the programs stored in the ROM 40, so that the CPU 30 sends the key-on signal KON, key code signal KC, touch signal IT and the like representing the key-depression state to the sound source 10.

Thus, the sound source 10 forms the musical tone signal having the tone color corresponding to the operation for making the sounds in response to several kinds of signals KON, KC, IT to be inputted thereto. For example, the frequency information is given by the key code signal, while the envelope information is given by the touch signal and key-on signal, by which the corresponding musical tone signal is to be generated.

In the second sound source 12, when the frequency information generating circuit 12*d* sends the F-number to the phase data generating circuit 12*e* under control of the control signal generating circuit 12*b*, the phase data generating circuit 12*e* sends phase data P to the musical tone signal forming circuit 12*a*, while the envelope generating circuit 12*f* sends the envelope index EL to the musical tone signal forming circuit 12*a*. At the same time, the control signal generating circuit 12*b* and parameter generating circuit 12*c* send the control signal mainly concerning the operation of setting the tone color to the musical tone signal forming circuit 12*a*.

The musical tone signal forming circuit 12*a* forms the musical tone signal corresponding to the set tone color information, wherein the operation of forming such musical tone signal is carried out by the waveform operation based on the predetermined algorithm.

Figure 6:
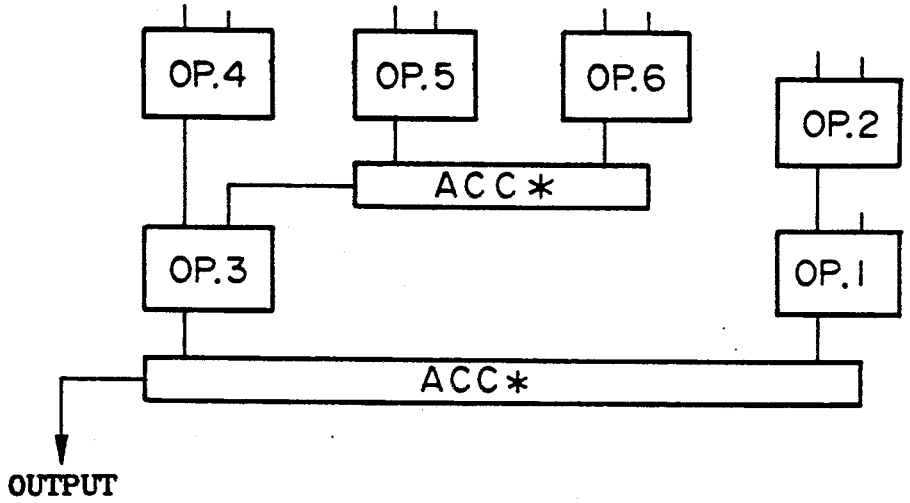
FIG. 6 is a diagram showing the algorithm of an embodiment of the present invention.

Next, description will be given with respect to the algorithm to be used in the musical tone signal forming circuit 12*a*. Herein, description will be given by referring to FIG. 6 showing an example of the algorithm which proceeds in accordance with the time chart shown in FIG. 7.

Hereinafter, the cycle which is required to operate one sample data of waveform will be referred to as "one operation cycle". In case of FIGS. 6, 7, one sample data is computed by six operations, each corresponds to one time slot. Therefore, one operation cycle consists of six time slots. In order to obtain the polyphonic output, each time slot is further divided into plural channels. So, the operation to be described with respect to each time slot is repeatedly performed by the number of channels provided in each time slot.

Hereinafter, the substantial operation unit will be simply referred to as "OP", so that six operation units, i.e., "OP6" to "OP1", are sequentially performed in six time slots. In the musical tone signal forming circuit 12*a*, the adder 200, sine-wave table 203, adder 204 and logarithm-linear conversion circuit 205 are used to perform the above-mentioned substantial operation units, while other portions are used to set the connection manner of the operation units. Therefore, the waveform operation represented by certain operation unit OPx can be represented by $$OPx \text{ output} = ELx * LCx * \sin(Px + \omega 1x + \omega 2x)$$

by use of the phase data Px, inputs for waveform signal (i.e., waveform data) ω1x, ω2x, modulation index LCx and envelope index ELx.

In order to perform the algorithm shown in FIG. 6, the following steps are required.

(1) The waveform operation is performed in OP6, which result is stored in the accumulation register.
(2) The waveform operation is performed in OP5, which result is accumulated in the accumulation register.
(3) The waveform operation is performed in OP4.
(4) The data accumulated in the accumulation register and operation result of OP4 are subject to the waveform operation in OP3, of which result is stored in the accumulation register.
(5) The waveform operation is performed in OP2.
(6) The operation result of OP2 is subject to the waveform operation in OP1, which result is accumulated in the accumulation register.
(7) The data accumulated in the accumulation register is outputted. Thereafter, the above-mentioned operations of seven steps are repeatedly performed from (1).

Incidentally, as the input data of OP6, OP5, OP4 and OP2, it is possible to use the data other than the operation results of other operation units. For example, it is posible to use the external data or noise data. However, if only the phase data P is required, "0" data is used as the input data of these operation units.

Next, detailed description will be given with respect to the above-mentioned operation proceedings in each time slot.

(a) Time Slot 1

In this time slot, only the operation unit OP6 performs the waveform operation. Herein, since the selectors 201*a*, 201*b* must input the waveform data other than the operation results of other operation units, the values of the control signals ISEL1, ISEL2 should be limited to the values "0" to "4", "9", "10" (which are represented by "A" in FIG. 7.

Since the above-mentioned values include the values "1" to "3", the feedback registers 209*a* to 209*c* can be set in the write enable state. In this case, the feedback registers input the data via the averaging circuit. Hence, the feedback registers do not directly input the outputs of other operation units.

Figure 7:
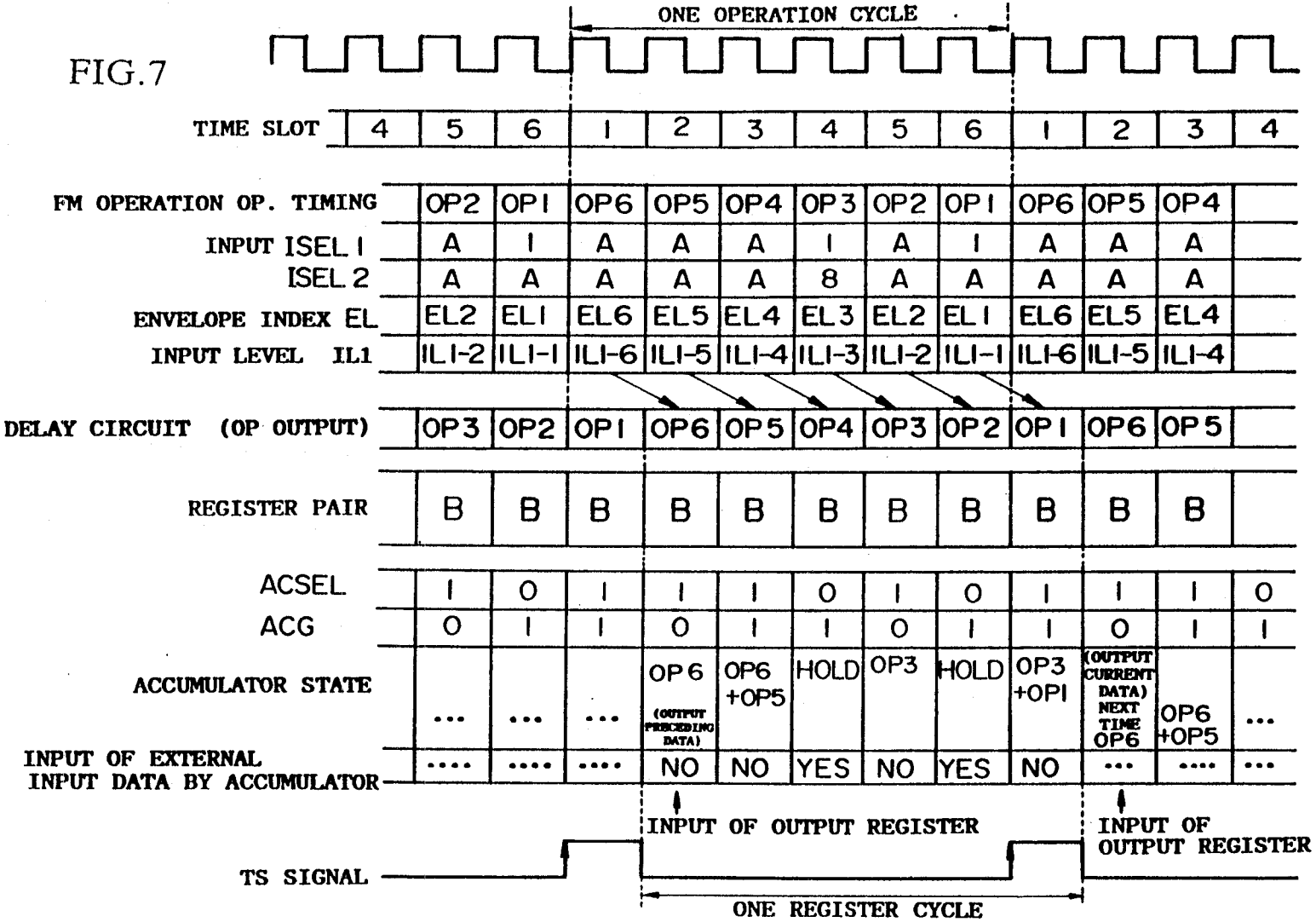
FIG. 7 is a timing chart to be used when executing the algorithm shown in FIG. 6.

The input information to be selected by the selectors 201*a*, 201*b* is subject to the level adjustment in the scalers 202*a*, 202*b* which are controlled by the control signals IL1, IL2 respectively. These control signals are respectively set as "IL1-6", "IL2-6". FIG. 7 indicates "IL1" only but omits "IL2".

Then, the adder 200 adds the phase data P to the waveform data ω1, ω2 outputted from the scalers 202*a*, 202*b*. When the addition result of adder 200 is inputted into the sine-wave table 203 as its address, the logarithmic value of the sine-wave function corresponding to the phase angle is read out. The adder 204 adds the logarithmic value to the modulation index LC6 and envelope index EL6. When the output of this adder 204 is inputted into the logarithm-linear conversion circuit 205, it is possible to obtain the non-logarithmic sine-wave function value, which is supplied to the delay circuit 206.

(b) Time Slot 2

The operation data (i.e., operation result) supplied to the delay circuit 206 in the above-mentioned time slot 1 is delayed by one time slot, so that it is outputted at time slot 2. In order to store this data in the accumulation register 216, the selector 210 must selects the input terminal 1 thereof. In addition, the gate 215 must be set in the off-state in order to prevent this data from being accumulated with the previous data. For this reason, the control signals ACSEL, ACG are respectively set at "1", "0".

As similar to the foregoing case of time slot 1, the waveform data to be inputted in OP5 and selected by the selectors 201*a*, 201*b* must be the data other than the operation data of other operation units in this time slot 2. Therefore, the control signals ISEL1, ISEL2 are at "A" according to the foregoing notation. In addition, the control signals IL1, IL2 to be used for the level adjustment in the scalers 202*a*, 202*b* are respectively set as "IL1-5", "IL2-5". Further, the modulation index LC and envelope index EL used in the adder 204 are respectively set as "LC5", "EL5".

When the waveform operation of this time slot 2 is performed, its operation data is supplied to the delay circuit 206, wherein it is delayed by one time slot.

(c) Time Slot 3

The operation data of OP5 to be computed in time slot 2 is outputted from the delay circuit 206 in this time slot 3. In order to accumulate this data in the accumulation register 216, the selector 210 is controlled to select the input terminal 1 thereof and the gate 215 is set in the on-state. For this reason, the control signals ACSEL, ACG are both set as the same value "1".

As for OP4, the control signals ISEL1, ISEL2 used in the selectors 201*a*, 201*b* are set at "A"; control signals IL1, IL2 used for the level adjustment in the scalers 202*a*, 202*b* are respectively set as "IL1-4", "IL2-4"; modulation index LC and envelope index EL are respectively set as "LC4", "EL4".

(d) Time Slot 4

The waveform data to be inputted in OP3 and selected by the selectors 201*a*, 201*b* is the operation data of OP4 and the data held in the accumulation register 216. Therefore, the selector 201*a* selects the output of delay circuit 206, while the selector 201*b* functions to set the output of selector 210 at "0" and also set the gate 215 in the on-state. Then, the data held in the accumulation register 216 must be sent to the selector 201*b* via the adder 211, so that the selector 201*b* can select such held data. In order to achieve the above-mentioned circuit operation, the control signals ISEL1, ISEL2 used in the selectors 201*a*, 201*b* must be respectively set at "1", "8"; and control signals ACSEL, ACG used for the selector 210 and gate 215 must be respectively set at "0", "1". Thus, the data stored in the accumulation register 216 can be held.

Incidentally, other control signals IL1, IL2, LC, EL are respectively set as "IL1-3", "IL2-3", "LC3", "EL3".

(e) Time Slot 5

In order to store the operation data of OP3 which is outputted from the delay circuit 206 in this time slot 5 in the accumulation register 216, the selector 210 must selects the input terminal 1 thereof and the gate 215 is set in the off-state. Therefore, the control signals ACSEL, ACG are respectively set at "1", "0".

In order to perform the waveform operation in OP2, the control signals IL1, IL2, LC, EL are respectively set as "IL1-2", "IL2-2", "LC2", "EL2".

(f) Time Slot 6

Herein, one of two waveform data inputted in OP1 and selected by the selector 201*a* is the operation data of OP2 outputted from the delay circuit 206 (see FIG. 6). Therefore, the control signal ISEL1 is set at "1". In order to select another waveform data to be inputted in OP1 and selected by the selector 201*b*, the control signal ISEL2 is set at "A".

On the other hand, it is required to hold the data stored in the accumulation register 216 as it is. Hence, in order that "0" data is outputted from the selector 210 and the gate 215 is set in the on-state, the control signals ACSEL, ACG must be respectively set at "0", "1".

The operation data of OP1 is delayed and then outputted from the delay circuit 206 in time slot 1 of next operation cycle. In this time slot 1, this operation data is accumulated into the operation data of OP3 which is stored in the accumulation register 216. In order that the selector 210 selects the input terminal 1 thereof and the gate 215 is set in the on-state, the control signals ACSEL, ACG are both set at the same value "1".

As described heretofore, the desirably operated waveform data can be obtained from the accumulation register 216, which is stored in and then outputted from the output register 224 in next time slot 2.

Incidentally, when the control signals ISEL1, ISEL2 used in the selectors 201*a*, 201*b* are both set at "A", it is possible to use the external input data as the waveform data. In order to input such external input data into the present apparatus, it is possible to employ the following two methods. According to one method, the selectors 201*a*, 201*b* select the output of the external input data register 218. According to another method, the external input data is inputted into the accumulation register 216 via the selector 210. In the latter method, by setting the gate 215 in the on-state, it is possible to accumulate the external input data into the data which has been already stored in the accumulation register 216. Incidentally, this accumulation register 216 is designed to add plural operation outputs together. While adding the operation outputs, this accumulation register 216 is not used to input the external input data. For this reason, the time chart shown in FIG. 7 indicates the period when the external input data can be inputted into the accumulation register 216, which is represented by "YES", while "NO" represents the period when the external input data cannot be inputted into the accumulation register 216. In short, by replacing the value of the control signal ACSEL from "0" to "2", it is possible to input the external input data.

In the column labeled "REGISTER PAIR" in FIG. 7, "B" indicates that the registers are in the write enable states in any timing.

In the above-mentioned example, the feedback registers are not used for performing the waveform operation. However, in the case where the output of the operation unit is used as its input again, it is possible to employ the algorithm shown in FIG. 8, which contents will be described below.

Figure 8:
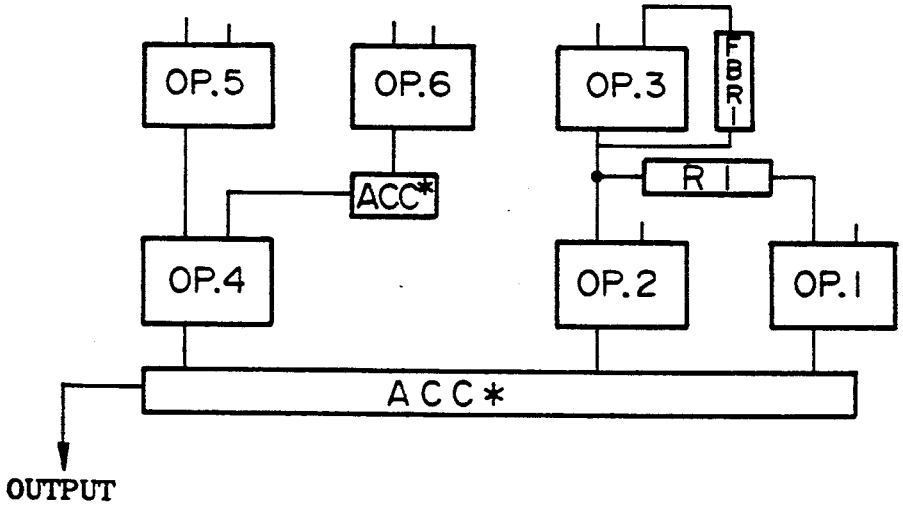
FIG. 8 is a diagram showing another example of the algorithm of an embodiment of the present invention.
Figure 9:
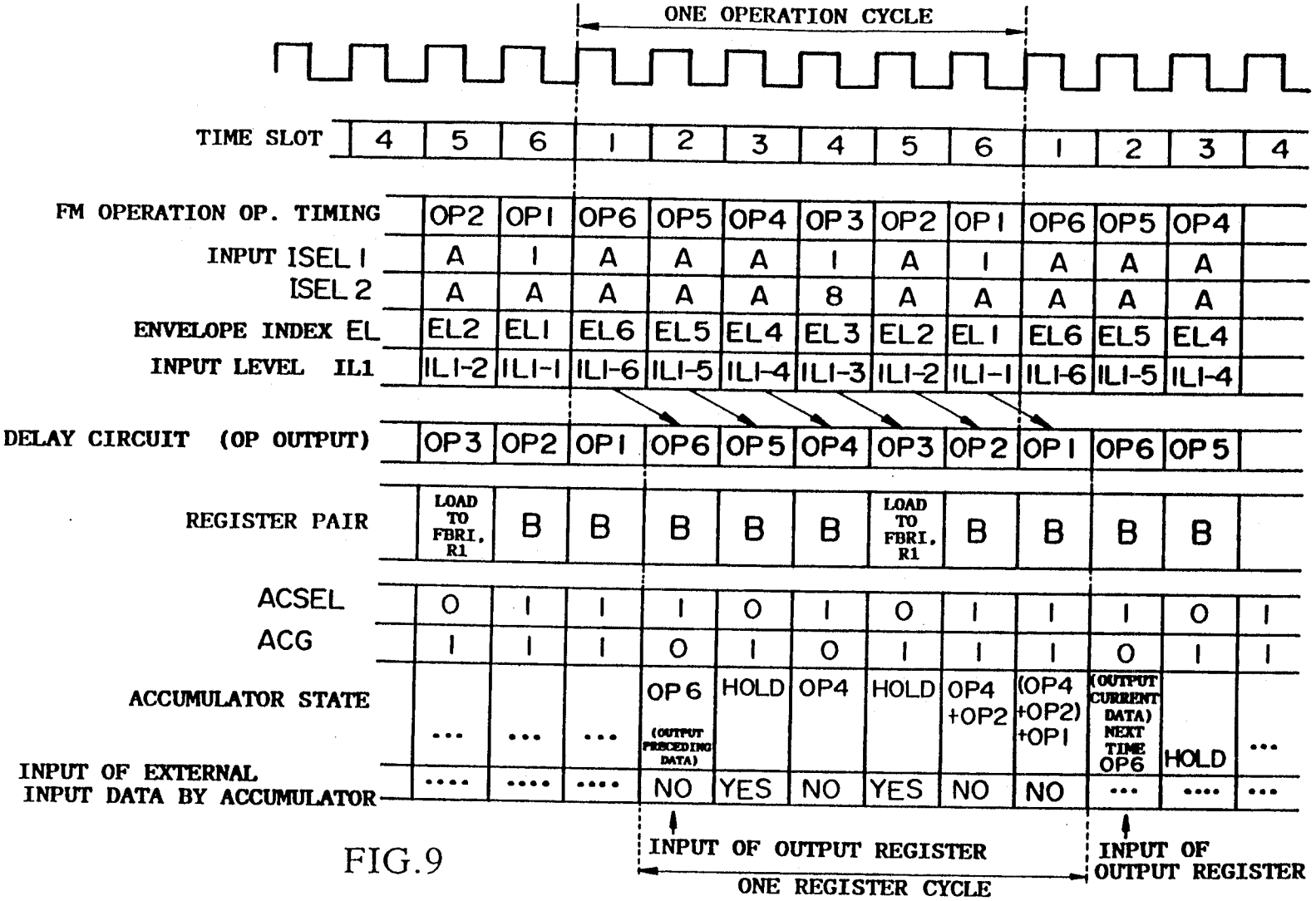
FIG. 9 is a timing chart to be used when executing the algorithm shown in FIG. 8.

In the algorithm shown in FIG. 8, the output of OP3 is used as the waveform data to be inputted in OP2. In addition, this output of OP3 is fed back to OP3 via the feedback register (FBR1, i.e., feedback register 209*a*), and it is also used as the waveform data inputted in OP1 via the register (R1, i.e., register 207*a*).

This algorithm will be performed in accordance with the following computation proceedings.

(1) The waveform operation is performed in OP6, which operation data is stored in the accumulation register.

(2) The waveform operation is performed in OP5.

(3) Both of the data stored in the accumulation register and operation data of OP5 are used as the waveform data inputted into OP4, wherein they are subject to the waveform operation, which operation data is stored in the accumulation register.

(4) The data of the feedback register is used as the waveform data inputted in OP3 wherein it is subject to the waveform operation, which operation data is supplied to the feedback register, register and OP2.

(5) The OP2 performs the waveform operation on the operation data of OP3, which operation result is accumulated in the accumulation register.

(6) The operation data of OP3 (i.e., data stored in the register) is used as the waveform data inputted in OP1 wherein it is subject to the waveform operation, which operation data is accumulated to the data of the accumulation register.

(7) The data of the accumulation register is outputted. Thereafter, the above-mentioned operations are repeatedly performed from (1).

Due to the above-mentioned operations, it is possible to obtain the desirably operated waveform data from the accumulation register.

In this case, the operation state of each time slot is as described below, wherein the operation states of time slots 1 to 3 are omitted because they can be easily understood from the description of the foregoing example.

(a) Time Slot 4

In order that the data held in the feedback register 209*a* is used as one of two waveform data inputted in OP3, the control signal ISEL2 used for the selector 201*b* is set at "2". As the other waveform data inputted in OP3, it is possible to selectively use the data which does not affect the algorithm. Therefore, the control signal ISEL1 used for the selector 201*a* is set at "A".

The other control signals IL1, IL2, LC, EL are respectively set as "IL1-3", "IL2-3", "LC3", "EL3".

(b) Time Slot 5

In order to store the operation data of OP3 outputted from the delay circuit 206 in the register 207*a*, the write signal WS1 is outputted at "1" level. In addition, the control signal FBSEL for the selector 214 is set at "1", so that the register 207*a* outputs the data held therein (i.e., the operation data of OP3 to be generated before one operation cycle from now) to the adder 208.

The adder 208 adds the operation data of OP3 outputted from the delay circuit 206 (at current operation cycle) to the data held in the register 207*a* (which is generated in the preceding operation cycle), so that averaged operation data can be supplied to the feedback registers 209*a* to 209*c*. In order to average the operation data with accuracy, the addition result of the adder 208 must be divided by two. Such division is carried out in the scalers 202*a*, 202*b*.

At this time, only the write signal WS1 is outputted, so that the operation data outputted from the adder 208 is supplied to the feedback register 209*a* only. Thereafter, in the time slot 4 in which the data of feedback register 209*a* is used as the waveform data to be inputted, the operation data of OP3 is averaged by the averaging circuit and then fed back as the waveform data.

In order that the operation data of OP3 is used as one of the waveform data inputted into OP2, the control signal ISEL1 for the selector 201*a* is set at "1" and another control signal for the selector 201*b* is set at "A". In this state, the waveform operation is performed.

(c) Time Slot 6

In order to accumulate the operation data of OP2 to the data stored in the accumulation register 216, the control signal ACSEL for the selector 210 is set at "1", while the control signal ACG for the gate 215 is also set at "1". In addition, the operation data of OP3 is used as one of two waveform data inputted in OP1. This operation data is held in the register 207*a* in the time slot 5. In order that the data held in the register 207*a* is used as one of the waveform data inputted in OP1, the control signal ISEL1 is set at "5".

The operation data of OP1 can be obtained at the time slot 1 in the next operation cycle. As described before, this operation data is accumulated to the data of the accumulation register 216. At next time slot, the operation result is outputted from the output register 224.

In the present embodiment, the registers 207*a* to 207*c* and feedback registers 209*a* to 209*c* are paired together to thereby form three register pairs. Thus, it is possible to obtain the averaged data from the feedback registers 209*a* to 209*c* or independently pick up the data from the registers 207*a* to 207*c*. Therefore, six kinds of outputs obtained from three register pairs can be selectively used as the waveform data to be inputted in each operation unit, which raises the degree of freedom of the algorithm.

Figure 10:
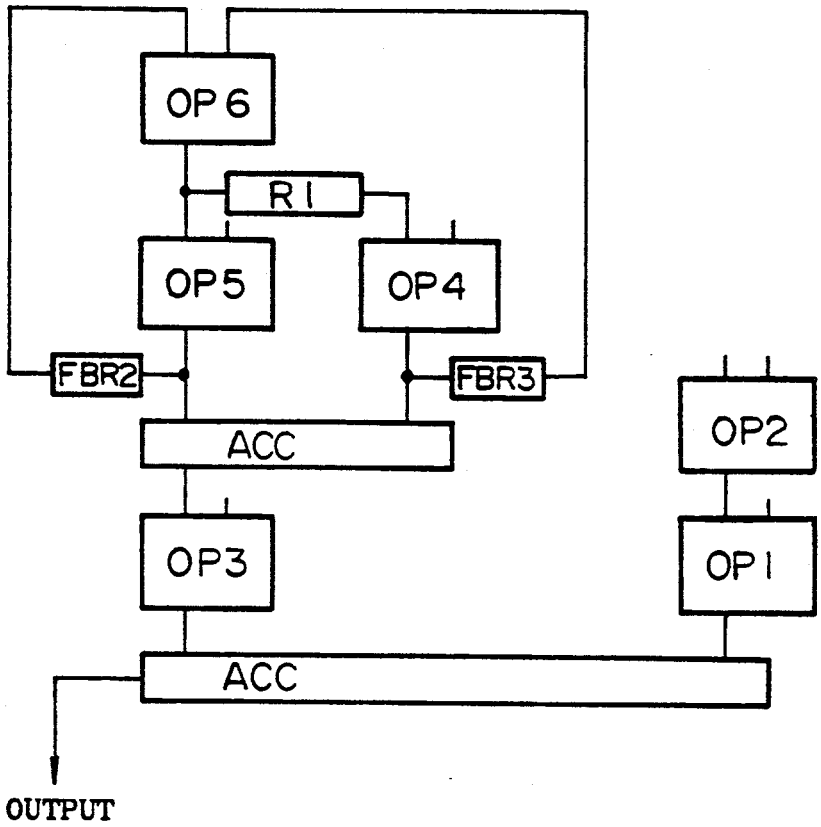
FIGS. 10 and 11 are diagrams showing still another examples of the algorithms.
Figure 11:
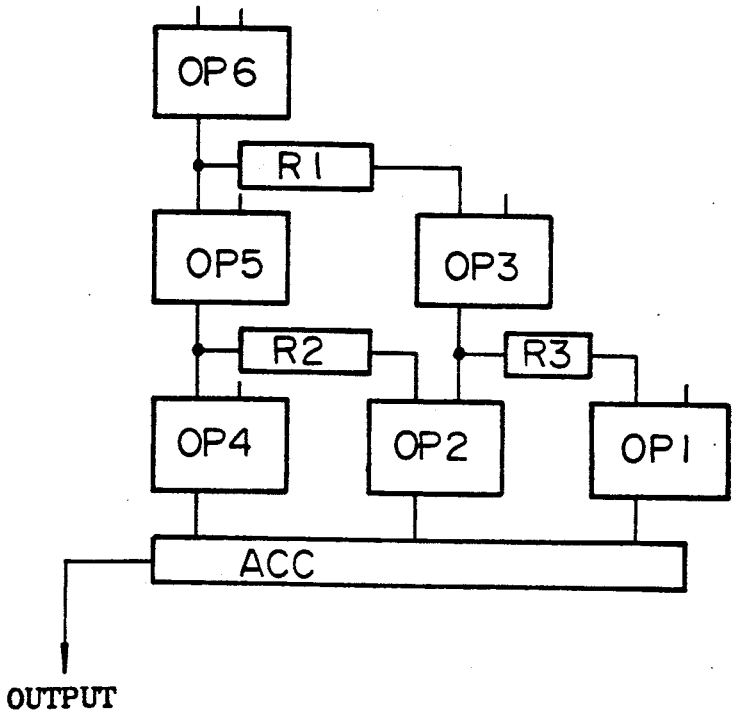

FIGS. 10, 11 show other examples of the algorithms which use the combination of the outputs of three register pairs.

For example, in case of FIG. 10, the operation data of OP6 is used as one of two waveform data inputted in OP5, OP4; and the operation data of OP5, OP4 are added together, which addition result is used as one of two waveform data inputted in OP3. In addition, the operation data of OP5, OP4 are independently fed back to OP6. Further, the operation data of OP2 is used as one of two waveform data inputted in OP1; and the operation data of OP1 is added to the operation data of OP3, which addition result is to be outputted.

Since the operation data of OP5, OP4 are accumulated, the operation data of OP6 must be held in the portion other than the accumulation register 216 when performing the waveform operation in OP5. At this portion, the register 207*a* must be used. In order to feed back the operation data of OP5, OP4, the feedback registers 209*b*, 209*c* are used. Therefore, all of three register pairs are used.

In case of FIG. 11, the operation data of OP6 is used as one of the waveform data inputted in OP5, OP3; the operation data of OP5 is used as the waveform data inputted in OP4, OP2; the operation data of OP3 is used as the waveform data inputted in OP2, OP1; and thereafter, all of the operation data of OP4, OP2, OP1 are accumulated together. In this case, the accumulation register 216 is used in OP4 etc. Thus, in order to hold the operation data of OP6, OP5, OP3, three register pairs are used. Herein, no feedback register is used. However, it is possible to use the feedback register when inputting the other waveform data into OP6, OP5, OP4, OP3, OP1.

As described heretofore, the desirably operated waveform data is obtained from the second sound source 12, and the mixer 14 mixes this waveform data into the waveform data outputted from the first sound source 11. Then, the mixed waveform data are converted into the analog signal by the D/A conversion circuit 80, so that the sound system 90 will generate the musical tone having the audio frequency.

According to the present embodiment, the operation data of each operation unit can be stored in various manners, and the waveform data inputted in each operation unit can be arbitrarily selected by the selectors 201*a*, 201*b*. In addition, the external waveform data can be also selectively used. Therefore, the operation of making the sounds can be performed in great degree of freedom. Further, input information selected by the selectors 201*a*, 201*b* can be adjusted by the scalers 202*a*, 202*b*. Thus, even when one operation data is inputted into plural operation units, it is possible to adequately adjust the input level.

Furthermore, the operation data is averaged by the former-stage registers 207*a* to 207*c*, selector 214, adder 208 and latter-stage feedback registers 209*a* to 209*c*, and the data stored in the feedback registers 209*a* to 209*c* can be respectively and selectively supplied to the adder 200 at different timings or at the same timing by the selectors 201*a*, 201*b*. Therefore, it is possible to perform the feedback operation by use of different waveform data in plural operation units. In addition, it is possible to perform the feedback operation by simultaneously using the different waveform data in single operation unit. Further, it is possible to use the operation data of former-stage registers 207*a* to 207*c* in other operation units, regardless of the operation data of latter-stage feedback registers 209*a* to 209*c*. This enlarges the scope of the algorithm which can be embodied.

In the present embodiment described before, the frequency modulation operation is carried out in the operation unit constructed by the adder 200, sine-wave table 203, adder 204 and logarithm-linear conversion circuit 205 so as to form the musical tone signal. However, the amplitude modulation operation can be used to form the musical tone signal in the present invention by use of the circuit as shown in FIG. 3 of Japanese Patent Laid-Open Publication No. 62-83795 which is described in the prior art.

As described heretofore, this invention may be practiced or embodied in still other ways without departing from the spirit or essential character thereof. Therefore, the present embodiment described herein is illustrative and not restrictive, the scope of the invention being indicated by the appended claims and all variations which come within the meaning of the claims are intended to be embraced therein.

What is claimed is:

1. A musical tone signal generating apparatus comprising:

a plurality of modulation operation systems each of which is applied with plural pieces of input information, each of said modulation operation systems carrying out a predetermined modulation operation on said input information applied thereto to thereby output waveform information as its operation results;

a plurality of memories each storing said operation result of each of said modulation operation systems; and a plurality of selecting units each selecting one of plural pieces of said waveform information stored in said memories, so that plural pieces of selected information are supplied to each of said modulation operation systems as said plural pieces of input information, whereby a waveform operation is carried out so as to generate a musical tone signal based on a algorithm determined by a selection pattern of said selecting units.

2. A musical tone signal generating apparatus according to claim 1 further providing a plurality of varying units for varying the selected information to be supplied to said modulation operation systems from said selecting units respectively.

3. A musical tone signal generating apparatus according to claim 1 wherein said plurality of modulation operation systems are constructed by modulation units of which number is smaller than that of said plurality of modulation operation systems, so that by using said modulation units in a time-sharing system, said modulation units carry out all operations of said plurality of modulation operation systems, while connections between said plurality of modulation operation systems and said memories are changed over is a time-sharing system.

4. A musical tone signal generating apparatus according to claim 1 wherein said selecting units select noise waveform information.

5. A musical tone signal generating apparatus according to claim 1 wherein said selecting units external waveform information which is supplied from an external device.

6. A musical tone signal generating apparatus comprising:

a plurality of modulation operation systems each carrying out a predetermined modulation operation on each of plural pieces of input information applied thereto to thereby output waveform information as its operation result;

plural pairs of first registers to be coupled together in parallel for temporarily storing plural pieces of waveform information outputted from said modulation operation systems;

adding means for adding current waveform data outputted from each of said modulation operation systems to preceding waveform data stored in said first registers to thereby form new waveform data;

plural pairs of second registers to be coupled together in parallel for temporarily storing said new waveform data outputted from said adding means; and selecting means for selectively outputting said new waveform data stored in said second registers to said modulation operation systems.

7. A musical tone signal generating apparatus comprising:

a plurality of modulation operation systems each carrying out a predetermined modulation operation on each of plural pieces of input information applied thereto to thereby output waveform information as its operation result;

plural pairs of first registers to be coupled together in parallel for temporarily storing plural pieces of waveform information outputted from said modulation operation systems;

adding means for adding current waveform data outputted from each of said modulation operation systems to preceding waveform data stored in said first registers to thereby form new waveform data;

plural pairs of second registers to be coupled together in parallel for temporarily storing said new waveform data outputted from said adding means; and selecting means for selectively outputting said waveform data stored in said first and second registers to said modulation operation systems.

8. A musical tone signal generating apparatus according to any one of claims 1, 6, 7, wherein said predetermined modulation operation is a frequency-modulation operation.

* * * * *